US009221281B2

(12) United States Patent
Adner

(10) Patent No.: US 9,221,281 B2
(45) Date of Patent: Dec. 29, 2015

(54) INKJET PRINTER LOADING ARRANGEMENT

(71) Applicant: Benjamin S. Adner, Swampscott, MA (US)

(72) Inventor: Benjamin S. Adner, Swampscott, MA (US)

( * ) Notice: Subject to any disclaimer, the term of this patent is extended or adjusted under 35 U.S.C. 154(b) by 93 days.

(21) Appl. No.: 13/998,251

(22) Filed: Oct. 15, 2013

(65) Prior Publication Data

US 2015/0103125 A1 Apr. 16, 2015

(51) Int. Cl.
*B41J 13/10* (2006.01)
*B41J 3/407* (2006.01)

(52) U.S. Cl.
CPC ..... *B41J 13/103* (2013.01); *B41J 3/407* (2013.01)

(58) Field of Classification Search
CPC ..... B41F 1/265; B41F 1/28; B41F 1/36
See application file for complete search history.

(56) References Cited

U.S. PATENT DOCUMENTS

| | | | | |
|---|---|---|---|---|
| 5,255,012 | A * | 10/1993 | Amano | 347/222 |
| 2012/0007300 | A1* | 1/2012 | Marcos et al. | 269/289 R |
| 2013/0008333 | A1* | 1/2013 | Peter et al. | 101/484 |
| 2013/0333579 | A1* | 12/2013 | Gerber | B41J 11/0015 101/113 |

* cited by examiner

*Primary Examiner* — Manish S Shah
*Assistant Examiner* — Renee I Wilson
(74) *Attorney, Agent, or Firm* — Don Halgren

(57) ABSTRACT

A system for enabling the sequential loading of a plurality of products to be printed on a printing machine. The system comprises a printer machine frame supported conveyor belt with a gantry supported printer head arranged transversely thereover. The system includes a loading system for enabling a plurality of parts to be printed, to be aligned in a print orientation at the loading end of the conveyor belt, wherein the loading system comprises a pair of spaced-apart, vertically displaceable lift members arranged across from one another at the loading and of the conveyor belt, and a product-receiving template adjustably supported between the vertically displaceable lift members at the loading end of the conveyor belt so as to enable temporary support and alignment of products on the conveyor belt to be printed, prior to their being printed by the printer head beneath the gantry.

13 Claims, 5 Drawing Sheets

INKJET PRINTER LOADING ARRANGEMENT

BACKGROUND OF THE INVENTION

1. Field of the Invention

This invention relates to inkjet printers and more particularly to loading systems for enabling an inkjet printer to be utilized with the printing of short-run objects which may be unstable by themselves, and which printer will be operated more efficiently, and which application is based upon Provisional Patent Application No. 61/795,358 filed 15 Oct. 2012 and incorporated herein by reference in its entirety.

2. Discussion of the Prior Art

In standard inkjet printer machines an elongated gantry is arranged transversely across a print table. The gantry may contain a computer-controlled printer head which slides on a set of rails along the longitudinal axis of the gantry. An operator lays a plurality of parts to be printed onto a rectilinear fixture or template which rests upon the "close" end of the table. That fixture or template is placed under the gantry and the printer head passes thereover to apply whatever print has been programmed therewith. Simultaneous loading of a template and the printing of an array of parts is inconsistent with the prior art. The fixtures or templates are arranged to hold whatever particular part to be printed under the printer head. Multiple fixtures however, are an expensive part to machine or mold to the particular often short-run peripheral configuration of the parts to be printed upon each time. Inkjet printers are often used to print promotional items which may have those limited runs due to possible "short-run" small amounts of promotional items required, for example, in the several hundreds, or even a thousand perhaps, the items being for instance, pens, souvenirs, lighters, mini-lights or the like, some of which are "unstable" if left to themselves on a table or printing surface, and would likely roll or fall over.

It is an object of the present invention to overcome the disadvantages of the prior art.

It is a further object of the present invention to provide a part-loading assembly to permit a high-efficiency feeding of the ink jet printer.

It is yet a further object of the present invention to provide an alignment arrangement for loading a variety of items to be printed, onto a conveyor belt, with minimal effort.

It is still another object of the present invention to provide a system for sequentially printing batches of possibly unstable items, wherein multiple, expensive fixtures don't have to be made for particular short run objects to be printed.

It is still yet a further object of the present invention to enable an ink jet batch-type or other stationary-part screen type printer machine to simultaneously be printing a batch of typically small short-run parts or part, while the same machine operator readies/loads a successive batch or part ready for printing.

BRIEF SUMMARY OF THE INVENTION

The present invention comprises a printing machine loading system for properly aligning and sequentially feeding small, often unstable, batches of multiple parts to an ink jet printing machine, particularly suited for short-run promotional-type products to be printed. The ink jet printing machine has a computer operated gantry defined by an elongated housing which encloses a computer controlled printer head which printer head is slidably supported on a plurality of rails therewithin, transversely across an elongated conveyor belt intermittently advanced in a time-wise manner therebeneath. The printer head is utilized to apply one or more colors of inks onto pre-aligned parts disposed on that conveyor belt therebeneath. The gantry is sequentially fed parts/products to be printed by the elongated conveyor belt. The conveyor belt is programmably heightwise-adjustable, and is empowered by, for example, a computer controlled motor which advances parts stepwise to a proper position beneath the gantry.

In a first aspect of the present invention, the loading system comprises an "align-and-release" template which is secured between a pair of programmably controllable, printed-part responsive, heightwise-adjustable template frame lift members. The template frame lift members are arranged for reciprocal vertical movement on both sides of the conveyor belt at its "loading" end. The template frame lift members in one embodiment, include a frame lift plate of generally "Y" shape. Each template frame lift plate has an inwardly directed conveyor-parallel flange arranged along its uppermost edge. Each flange includes at least one lock tab and at least one alignment pin thereon, at each side of the conveyor belt. Each template frame lift plate is connected to a computerizably-adjustable coordinated lift mechanism arranged onto the machine frame on both sides of the printing machine. The template is however preferably properly oriented by abutment with three template positioning, spaced-apart, alignment pins.

In one preferred embodiment of the present invention, the lift mechanism for moving the respective side frame lift plates, is an eccentrically rotated cam wheel in rotative contact with a lift pin arranged on the respective side frame lift plates, so as to rotatively engage same and effect programmed height-controlled lifting and lowering of the pair of side frame lift plates.

An "align-and-release" template in a preferred aspect of the present invention is thus secured between the opposed flanges at the upper end of each respective side's template frame lift plate and is secured thereto by a plurality of locking tabs arranged on the respective flanges. The align and release template is aligned properly with respect to the conveyor belt by being in close-fitting mating contact with the alignment pins also arranged on each flange on the upper sides of the side template frame lift plates.

In operation of one aspect of the present invention, the align-and-release template is adjustably set into place resting on the spaced apart parallel flanges of each respective side frame lift plate, by engagement with the three alignment pins. The align-and-release template has a plurality of openings spaced and aligned thereon, configured to the size and shape of the product to be printed.

The machine operator places the products to be printed in those respective openings on the align-and-release template. The machine operator then instructs the machine, through the proper printing machine control computer and software, as to the particular physical characteristics of the product to be printed.

The gantry may move by its own independent gantry drive towards and away from the load end of the conveyor belt, as required to shorten the run time of the printing machine. The pair of side template frame lift plates are effected so as to lift the align-and-release template off of and vertically away from the products which were placed within its openings and thus onto the conveyor belt. The conveyor belt is then stepwise advanced by the machine's proper control computer so as to bring those now "non-supported and un-held" stable aligned products to be printed, under the gantry so as to be printed by the printer head carried thereunder. During that printing operation of the unsupported (stable) products on the conveyor belt, such as for example an array of blocks or an array of Rubik's Cubes™, the align-and-lift template is returned to a position onto or just above the surface of the conveyor belt, so that the operator may again fill those openings with further similar products to be printed simultaneously as a previous batch is being printed. The load aspect of the printing machine again goes through the cycle of lifting the align-and-release template vertically away from those (stable) products to be printed which are now residing on the conveyor belt at its load end. That new sequence of aligned, released, stable array of products to be printed are then shuttled to a proper printing location under the gantry carrying the printer head. Those already-printed products are advanced towards the other end of the conveyor belt for discharge therefrom, the print operation being enabled to load parts onto the load end of the conveyor belt simultaneously as the previous template enabled batch is being printed.

In a further aspect of the present invention, the side template frame lift plate may also be programmably moved upwardly and downwardly with respect to the conveyor belt by means such as for example, a computer controlled motorized rack and pinion gear arranged between the inner of the side frame lift plate and the outer side of the printing machine, so as to facilitate movement of an align-and-release template towards and away from the conveyor belt on which is supported the collection of products to be printed.

In yet a further aspect of the present invention, the align-and-release template may be replaced with a generally "J" shaped alignment plate and a "align, hold and move" template for use with products to be printed which are somewhat unstable, and must be held in a supportive template throughout its entire printing operation. Such unstable products for example, may be a ballpoint pen or something of roundish shape which would roll or move if not held within an opening in a "movement-restricting" template.

The "J" shaped alignment plate is thus secured into its proper location by abutting contract with the at least three of the alignment pins on the side flanges, that is, one on one side flange of the side lift plate and at least two other alignment pins on the other side and back of the frame lift plate. An "align, hold-and-move" template is placed in registration against the inner edges of the "J" shaped alignment plate. The "align, hold-and-move" template likewise, has a plurality of product receiving openings thereon, such as troughs for maintaining a secure, upright holding of an array of promotional-type products such as for example, a ball point pen, shaped so as to properly align, secure and move-with a plurality of products to be printed. The operator in this aspect of the present invention, loads those products to be printed in the respective openings of the "align, hold and move" template. The machine is instructed to advance the conveyor belt with of the "align, hold-and-move" template thereon, also hence carrying the respective products to be printed, out of juxtaposition with the "J" shaped alignment plate and into a supported location under the gantry so the printer head may print them accordingly, while those products are held stable in the "align, hold and move" template. As such printing of an initial collection of template stabilized products is ongoing, the machine operator simultaneously places further products in another "align, hold-and-move" template into the properly secured/pin-aligned "J" shaped alignment plate and proceeds to put further products into that align and move template's openings for subsequent printing once the previous collection of parts to be printed has been accomplished. The side frame lift plates and their respective flanges remain in their horizontal location, with only the "align, hold-and-move" template (and products to be printed) advancing to a gantry location, and thereafter to the downstream end of the conveyor belt for offloading therefrom.

The invention thus includes a system for enabling the sequential loading of a plurality of products to be printed on a printing machine, the system comprising: a printer machine frame supported conveyor belt with a gantry supported printer head arranged transversely thereover, the conveyor belt having a first or loading end; a loading system for enabling a plurality of parts to be printed, to be aligned in a print orientation at the loading end of the conveyor belt, wherein the loading system comprises a pair of spaced-apart, vertically displaceable lift members arranged across from one another at the loading and of the conveyor belt; and a product-receiving template adjustably supported between the vertically displaceable lift members at the loading end of the conveyor belt so as to enable temporary support and alignment of products on the conveyor belt to be printed, prior to their being printed by the printer head beneath the gantry. The product receiving template has a plurality of product receiving openings spaced thereacross, to permit entry and alignment of products therein. The vertically displaceable lift members at the loading end of the conveyor belt are arranged to vertically displace the product receiving template after the product receiving template has been loaded with a plurality of products to be printed. The loading system includes a peripheral alignment plate for aligning an "align-hold-and-move" template therewithin. The peripheral alignment plate is preferably three sided and of "J" shape. The align-hold-and-move template moves with products loaded thereon towards the gantry. The lift members each have a flange extending inwardly towards one another. A plurality of lock tabs are spaced on the flanges, to secure a template thereon. A plurality of alignment pins are spaced on the flanges, to align the peripheral template thereon. The alignment pins thus align the peripheral alignment plate with respect to the flanges.

The invention also includes a method of sequentially loading of a plurality of template-supported products to be printed on a printing machine, the printing machine having a frame supported conveyor belt with a gantry supported printer head arranged transversely thereover, the conveyor belt having a first or loading end and a rear or discharge/offload end, the method comprising one or more of the following steps of: adjusting the height of the conveyor belt relative to the gantry; registering an outer corner of an outer alignment template to the frame of the print machine; placing a product specific template into close-fitting relationship with an inner periphery of an outer alignment template supported on frame lift plates, and over the conveyor belt; loading the products to be printed into positions in the product specific template positioned over the conveyor belt; operating the machine to lift the outer alignment template upwardly from the now aligned products in the product specific template to be printed, resting on the load end of the conveyor belt; leaving the product specific template with the products thereon, aligned and supported on the conveyor belt; advancing the template-supported products in the product specific template to be printed, into a position under the print head; lowering a fresh unloaded product specific template into position within the inner periphery of the alignment bracket so as to present an unloaded product specific template ready for loading of products; and loading a successive array of products to be printed onto the fresh product specific template as a prior array is printed by the print head in the gantry. The method may include: aligning the template to the proper position by close fitting engagement with a plurality of alignment pins on the flange supported by the lift plates, wherein the outer alignment template is of "J" shape to permit the product specific template therewithin a side from which to exit.

The invention also preferably includes a method of sequentially loading and printing of a plurality of un-supported products to be printed on a printing machine, the printing machine having a frame supported conveyor belt with a gantry supported printer head arranged transversely thereover, the conveyor belt having a first or loading end, the method comprising: adjusting the height of the conveyor belt relative to the gantry; registering a product specific template to flanges movably supported on the frame of the print machine; placing a product specific template into close-fitting relationship with an outer alignment corner of a flange on the print machine, and over the conveyor belt; loading a plurality of products to be printed into a plurality of openings positioned in the product specific template positioned over the conveyor belt; operating the machine to lift the product specific template from the now aligned products on the conveyor belt to be printed, now resting on the load end of the conveyor belt; leaving the product specific template lifted over the frame of the print machine with the products aligned and un-supported on the conveyor belt; advanced the conveyor belt and the un-supported products to be printed thereon, into a position under the print head; lowering the product specific template to a product load orientation over the conveyor belt at the load end thereof; and loading a successive array of products to be printed onto the template. The product specific template may be cyclically moved up and down by a rack and pinion gear arrangement between the frame of the printing machine and the flanges of the machine.

BRIEF DESCRIPTION OF THE FIGURES

The objects and advantages of the present invention will become more apparent when viewed in conjunction with the following figures, in which.

DETAILED DESCRIPTION OF THE PREFERRED EMBODIMENTS

Figure 1:
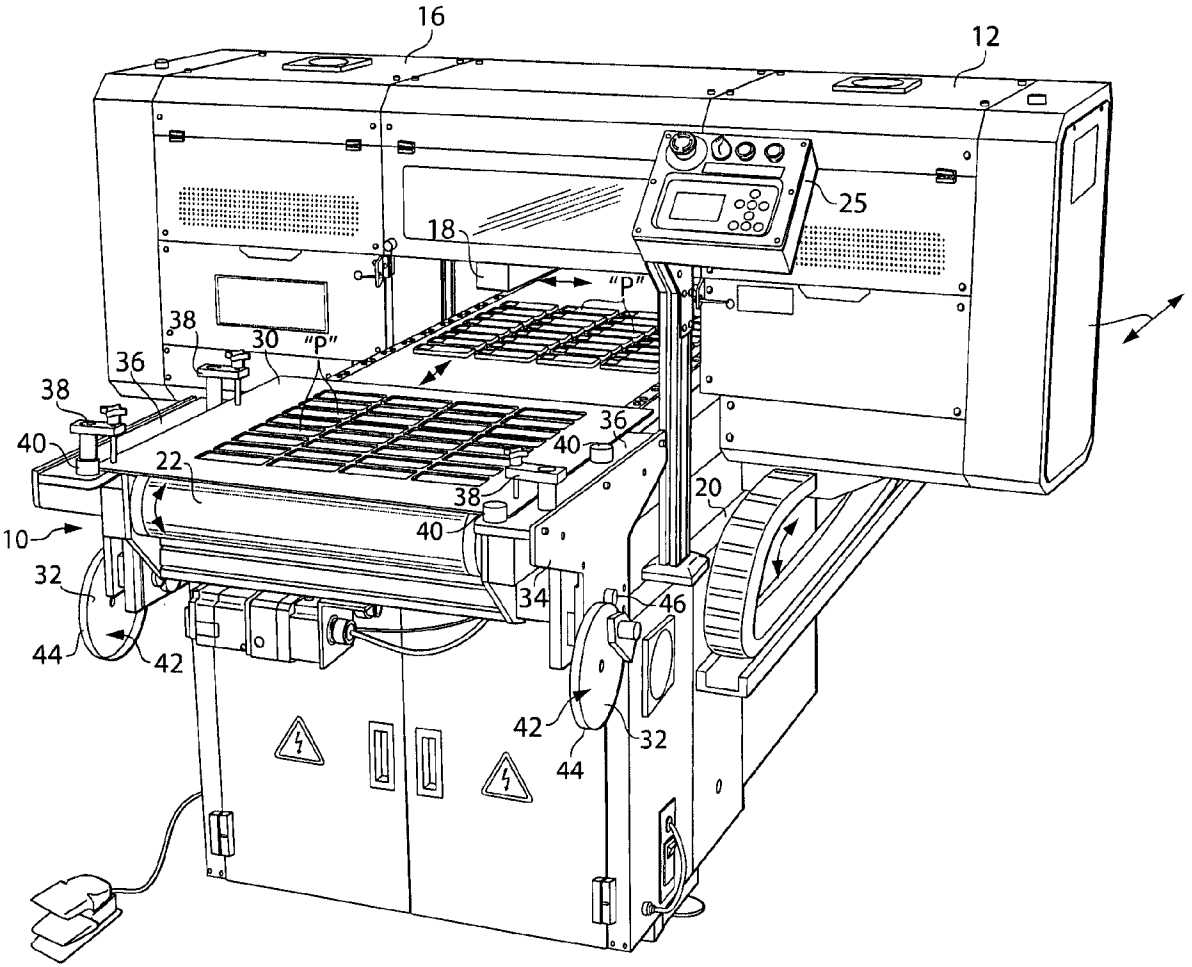
FIG. 1 is a perspective view of an ink jet printer having an elongated conveyor belt, and a print-part loading system arranged at its feed end.
Figure 2:
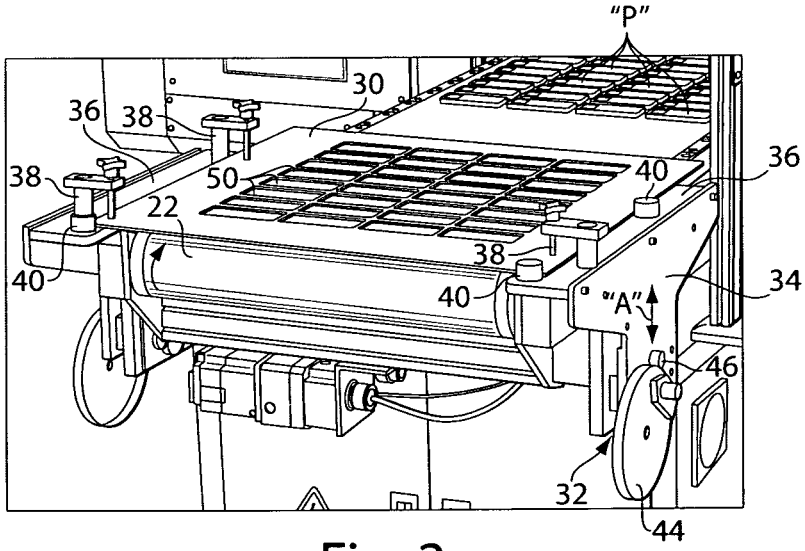
FIG. 2 is a close-up view taken in perspective of the print part loading system at the feed end of the conveyor belt.

The present invention comprises a printing machine loading system 10, as represented in a first preferred embodiment in FIGS. 1 and 2, for properly aligning and sequentially feeding multiple parts "P" to an ink jet printing machine 12, particularly suited for short-run promotional-type products to be printed. The ink jet printing machine 12 has a computer operated gantry 14 defined by an elongated housing 16 which encloses a computer controlled printer head 18 which printer head 18 is slidably supported on a plurality of rails 20 therewithin, transversely across an elongated conveyor belt 22 which belt 22 is intermittently advanced in a timewise manner therebeneath. The printer head 18 is utilized to apply one or more colors of inks onto pre-aligned parts "P" disposed on that conveyor belt 22 therebeneath. The gantry 14 is sequentially shuttled parts/products "P" to be printed on the elongated conveyor belt 22. The heightwise programmably adjustable conveyor belt 22 is empowered by, for example, a computer controlled motor, not shown for clarity, which advances parts "P" stepwise to a proper position beneath the gantry 14. A machine operator may input data through a data entry port 25, represented in FIGS. 1, 4 and 5.

Figure 3:
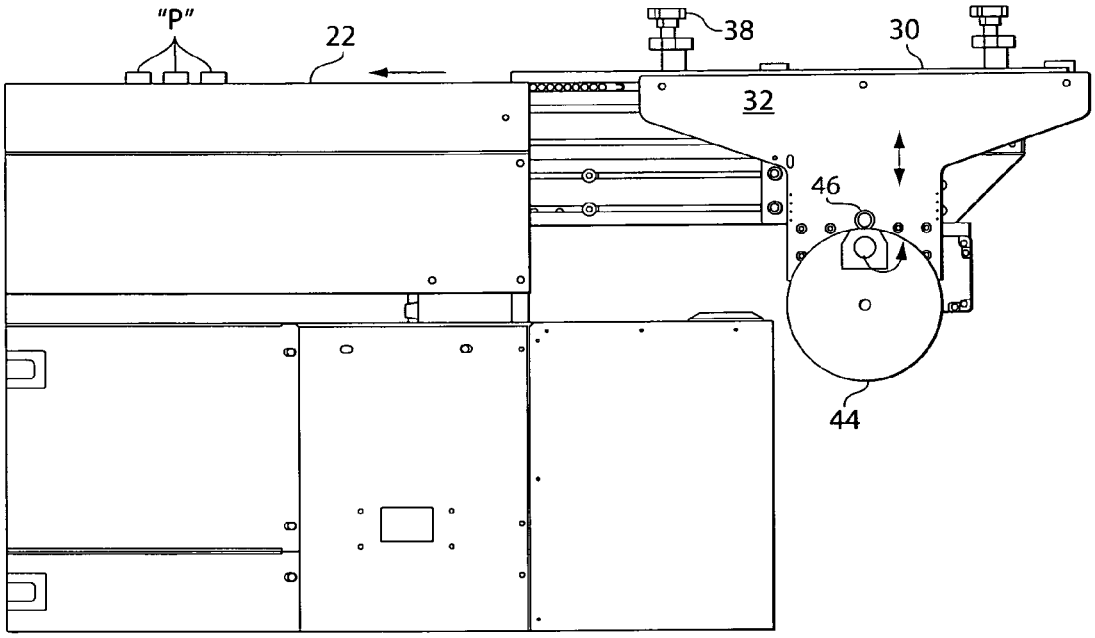
FIG. 3 is a side elevational view of the feed and of the conveyor belt showing portions of the lift system and its associated cam wheel.

In a first aspect of the present invention, the loading system comprises a rectilinearly shaped "align-and-release" template 30 which is secured between a pair of programmably, vertically adjustable template frame lift members 32 movable supported on the side of the frame of the printing machine 12. The template frame lift members 32 are arranged for reciprocal vertical movement on both sides of the conveyor belt 22 at its "loading" end, closest to the viewer as represented in FIGS. 1, 2, 4 and 5. The template frame lift members 32 include a frame lift plate 34 of generally "Y" shape, as represented in FIGS. 1, 2 and 3. Each template frame lift plate 34 has an inwardly directed conveyor-parallel flange 36 arranged along its uppermost edge, as may be seen in FIGS. 1, 2 and 4. Each flange 36 includes at least one lock tab 38 and at least one alignment pin 40 thereon, at each side of the conveyor belt 22 as represented in FIGS. 1, 2, 3, 4 and 5, with one pin 40 shown at a rear portion thereof. Each template frame lift plate 34 is connected to a coordinated computer controlled, programmed lift mechanism 42 arranged to the machine frame on both sides of the printing machine 12.

In one preferred embodiment of the present invention, the lift mechanism 42 for moving the respective side frame lift plates 34, is an eccentrically rotated cam wheel 44 in rotative contact with a lift pin 46 arranged on the respective side frame lift plates 34, so as to rotatively engage same and effect respective controlled lifting and lowering of the pair of side frame lift plates 34, as indicated by arrows "A" shown in FIG. 2.

The "align-and-release" template 30 in a preferred aspect of the present invention, as represented in FIGS. 1, 2, 3 and 4, is thus secured between the opposed flanges 36 at the upper end of each respective side's template frame lift plate 34 and is secured thereto by a plurality of locking tabs 38 arranged on the respective flanges 36 as best shown in FIG. 2. The align-and-release template 30 is aligned properly with respect to the conveyor belt 22 for subsequent downstream printing of the parts "P" it releases, by being in close-fitting mating contact with the alignment pins 40 also arranged on each flange 36 on the upper sides of the side template frame lift plates 34.

In operation of one aspect of the present invention, the "align-and-release" template 30 is adjustably set into place resting on the spaced apart parallel flanges 36 of each respective side frame lift plate 34. The "align-and-release" 30 template has a plurality of openings 50 spaced alignably thereon, customizably configured to the size and shape of whatever particular product is to be printed.

The machine operator places the products to be printed in those respective openings 50 on the align-and-release template 30. The machine operator then instructs the machine, through the proper printing machine control computer and software, as to the particulars of the product "P" to be printed.

The gantry 14 may move by its own independent gantry drive towards and away from the load end of the conveyor belt 22, as required to shorten the run time of the printing machine 12. The pair of side template frame lift plates 34 are effected so as to lift the "align-and-release" template 30 off of and vertically away from the products "P" which were placed within its openings 50 and thus onto the conveyor belt 22. The conveyor belt 22 is then stepwise advanced by the machine's proper control computer so as to bring those now "non-supported and un-held" stable aligned products "P" to be printed, under the gantry 14 so as to be printed by the printer head 18 carried thereunder. During that printing operation of the unsupported (stable) products "P" on the conveyor belt 22, the align-and-lift template 30 is returned to a position onto or just above the surface of the conveyor belt 22, so that the operator may again fill those openings 50 with another collection of similar products "P" to be printed. The printing machine 12 again goes through the cycle of lifting the align-and-release template 30 away from those products "P" to be printed now residing on the conveyor belt 22 at its load end. That new sequence of aligned products "P" to be printed are then shuttled to a proper printing location under the gantry 14 carrying the printer head 18. Those already-printed products "P" are advanced towards the other end of the conveyor belt 22 for discharge therefrom.

Figure 4:
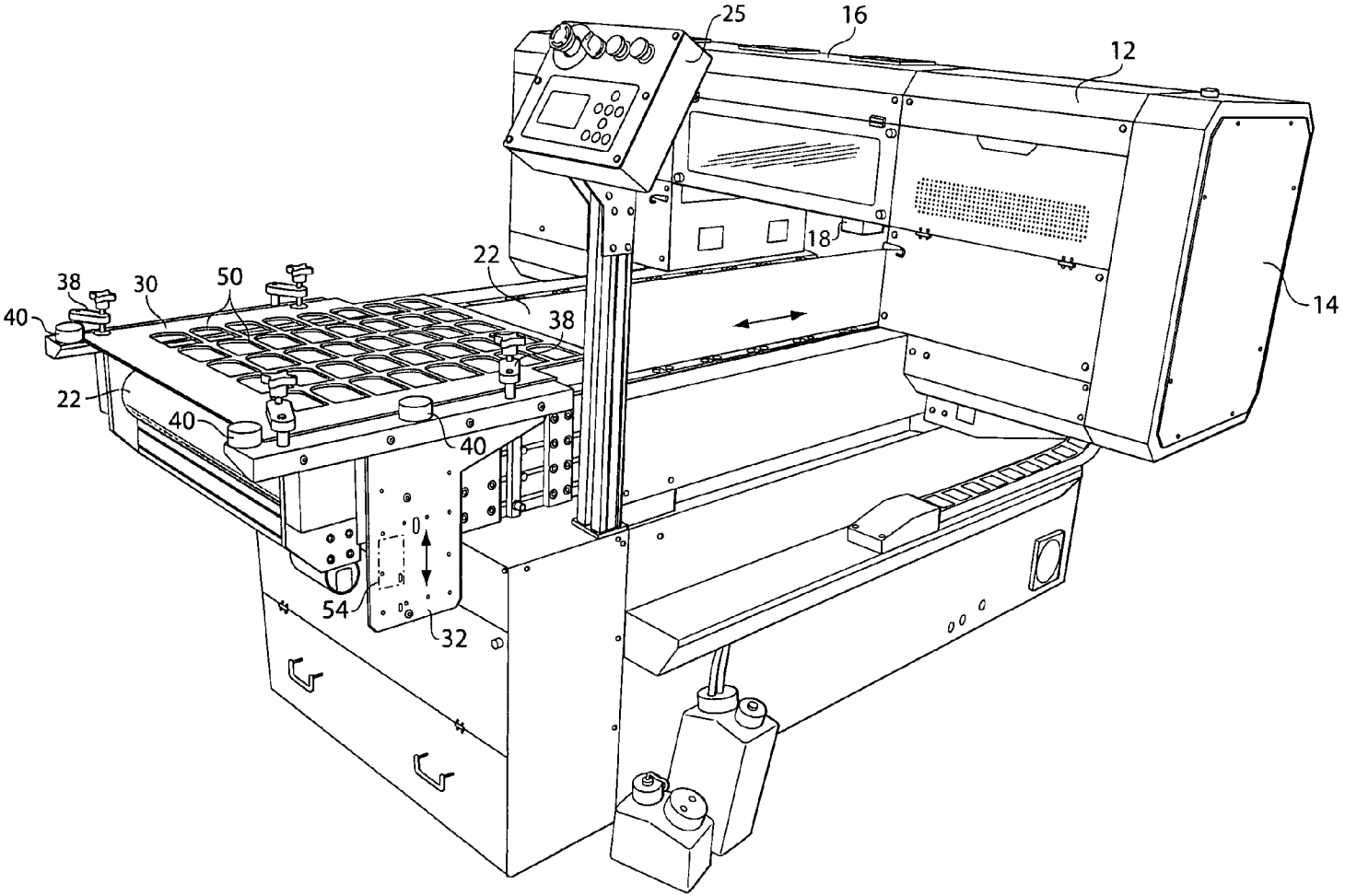
FIG. 4 is a further embodiment of the template alignment arrangement.

In a further aspect of the present invention, the side template frame lift plate 34 may also be moved upwardly and downwardly with respect to the conveyor belt 22 by means such as for example, a computer controlled motorized rack and pinion gear 54, represented by dashed lines in FIG. 4, arranged between the inner of the side frame lift plate 32 and the outer side of the printing machine 12, so as to facilitate movement of an align-and-release template 30 towards and away from the conveyor belt 22 on which supports the collection of products "P" to be printed.

Figure 5:
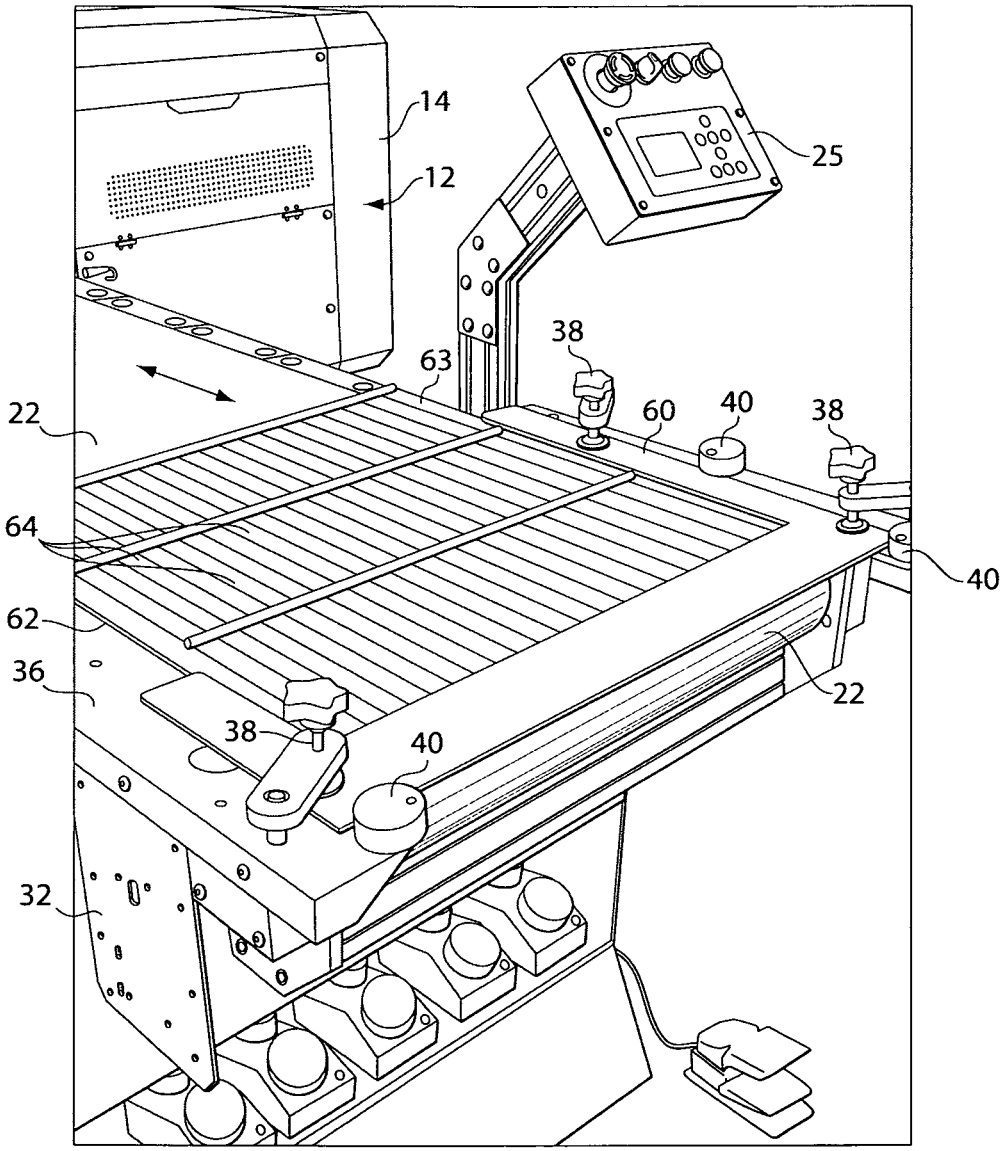
FIG. 5 is a perspective view of a further embodiment of the template arrangement of the present invention.

In yet a further aspect of the present invention, the align-and-release template may be replaced with a generally "J" shaped, peripheral alignment plate 60 and a "align, hold and move" template 62, as represented in FIG. 5, for use with products to be printed which are somewhat unstable, and must be held in a supportive template throughout its entire printing operation. Such unstable products for example, may be a ballpoint pen or something of roundish shape which would roll or move if not held within a trough-like opening 64 in a "movement-restricting" template such as the "align, hold and move" template 60 represented in FIG. 5.

The adjustably removable "J" shaped outer alignment plate 60 is thus secured into its proper location by abutting contract with the at least three of the alignment pins 40, on the side flanges 36 as represented in FIG. 5, that is, one on one side flange of the side lift plate 34 and at least two other alignment pins 40 on the other side frame lift plate 40 shown thereon. An "align, hold-and-move" template 62 is thus placed in registration against the inner edges of the "J" shaped alignment plate 60. The align, hold-and-move template 62 likewise, has its plurality of product receiving openings 64 thereon, such as troughs for holding a promotional product such as for example, a ball point pen, shaped so as to properly align, secure and move-with a plurality of products to be printed. The operator in this aspect of the present invention, loads those products to be printed in the respective openings 64 of the "align, hold and move" template 62. The machine is instructed to advance the conveyor belt 22 with of the "align, hold-and-move" template 62 thereon, also hence carrying the respective products to be printed, out of juxtaposition with the "J" shaped alignment plate and into a location under the gantry 14 so the printer head 18 may print them accordingly, while those products are held stable in their respective openings 64 in the "align, hold and move" template 62. As such printing of an initial collection of template stabilized products is ongoing, the machine operator places further products in another "align, hold-and-move" template into the properly secured/pin-aligned "J" shaped alignment plate and proceeds to put further products into that align and move template's openings for subsequent printing once the previous collection of parts to be printed has been accomplished. The side frame lift plates 34 and their respective flanges 36 remain in their horizontal location, with only the "align, hold-and-move" template 62 (and any products "P" to be printed) advancing to a gantry location, and thereafter to the downstream end of the conveyor belt for offloading therefrom.

Thus what has been shown is a novel system loading arrangement for enabling a plurality of short run parts to be printed in an ink jet printer. The loading arrangement comprising an operator controlled fixture positioning mechanism to permit alignment and stability of those parts to be printed by the inkjet printer and to enable the reloading of subsequent parts to a further template or the same template, depending upon the "stability" and hence particular template selection, while a previous batch is being printed.

The invention claimed is:

1. A system for enabling the sequential loading of a plurality of products to be printed on a batch-part printing machine while a previous loaded batch of parts is being printed, the system comprising:

a printer machine frame supported conveyor belt with a gantry supported printer head arranged transversely thereover, the conveyor belt having a loading end;

a loading system for enabling a plurality of parts to be printed, to be aligned in a print orientation at the loading end of the conveyor belt, wherein the loading system comprises a pair of spaced-apart, vertically displaceable lift members arranged across from one another at the loading end of the conveyor belt; and a product-receiving template adjustably supported between the vertically displaceable lift members at the loading end of the conveyor belt so as to enable temporary support and alignment of products on the conveyor belt to be printed, prior to their being printed by the printer head beneath the gantry, wherein the product receiving template has a plurality of product receiving openings spaced thereacross, to permit entry and alignment of products therein.

2. The system for enabling the sequential loading of a plurality of products to be printed on a printing machine as recited in claim 1, wherein the vertically displaceable lift members at the loading end of the conveyor belt are arranged to vertically displace the product receiving template after the product receiving template has been loaded with a plurality of products to be printed.

3. The system for enabling the sequential loading of a plurality of products to be printed on a printing machine as recited in claim 1, wherein the loading system includes a peripheral alignment plate for aligning an align-hold-and-move template therewithin.

4. The system for enabling the sequential loading of a plurality of products to be printed on a printing machine as recited in claim 3, wherein the peripheral alignment plate is of "J" shape.

5. The system for enabling the sequential loading of a plurality of products to be printed on a printing machine as recited in claim 4, wherein the align-hold-and-move template moves with products loaded thereon towards the gantry.

6. The system for enabling the sequential loading of a plurality of products to be printed on a printing machine as recited in claim 1, wherein the lift members each have a flange extending inwardly towards one another.

7. The system for enabling the sequential loading of a plurality of products to be printed on a printing machine as recited in claim 6, wherein a plurality of lock tabs are spaced on the flanges, to secure a template thereon.

8. The system for enabling the sequential loading of a plurality of products to be printed on a printing machine as recited in claim 6, wherein a plurality of alignment pins are spaced on the flanges, to align a template thereon.

9. The system for enabling the sequential loading of a plurality of products to be printed on a printing machine as recited in claim 8, wherein the alignment pins align the peripheral alignment plate with respect to the flanges.

10. The system as recited in claim 1, wherein the printing machine is an ink jet printing machine.

11. The system for enabling the sequential loading of a plurality of products to be printed on a printing machine as recited in claim 4, wherein the "J" shaped peripheral alignment plate is secured into a proper alignment location by at least three alignment pins.

12. The system for enabling the sequential loading of a plurality of products to be printed on a printing machine as recited in claim 1, wherein the gantry with the printer head therewith is arranged to move towards and away from the load end of the conveyor belt to shorten the run time of the printing machine.

13. The system for enabling the sequential loading of a plurality of products to be printed on a printing machine as recited in claim 1, wherein the products being printed are free of support during the printing process.

* * * * *